US007814707B1

(12) United States Patent
Hurst

(10) Patent No.: US 7,814,707 B1
(45) Date of Patent: Oct. 19, 2010

(54) CRAWL SPACE ACCESS DOOR ASSEMBLY HAVING FRAME WITH REMOVABLE RIBS IN RIB RECEIVING GROOVES

(76) Inventor: Steven L. Hurst, 191 Hurstville Rd., Moon, VA (US) 23119

( * ) Notice: Subject to any disclaimer, the term of this patent is extended or adjusted under 35 U.S.C. 154(b) by 0 days.

(21) Appl. No.: 12/150,196

(22) Filed: Apr. 25, 2008

Related U.S. Application Data

(60) Provisional application No. 60/926,342, filed on Apr. 26, 2007.

(51) Int. Cl.
*E05C 21/02* (2006.01)
*E06B 7/22* (2006.01)
*E06B 1/60* (2006.01)

(52) U.S. Cl. ..... 49/465; 49/464; 49/489.1; 49/498.1; 49/504

(58) Field of Classification Search ..... 49/465, 49/463, 504, 501, 489.1, 498.1, 479.1, 464
See application file for complete search history.

(56) References Cited

U.S. PATENT DOCUMENTS 1,904,910 A * 4/1933 Wideman et al. ..... 49/489.1
3,690,037 A * 9/1972 Kempel ..... 49/380
3,858,355 A * 1/1975 Root ..... 49/363
3,959,926 A * 6/1976 Noecker et al. ..... 49/181
4,006,562 A * 2/1977 Belanger et al. ..... 49/380
4,112,621 A * 9/1978 Ehrhart et al. ..... 49/400
4,268,997 A * 5/1981 Conkey ..... 49/383
4,363,349 A * 12/1982 Childs ..... 160/90
D273,994 S 5/1984 Naka
4,567,697 A * 2/1986 Hahne ..... 52/19
4,658,548 A * 4/1987 Gerritsen ..... 49/498.1
4,663,885 A * 5/1987 Stibolt ..... 49/67
4,807,397 A * 2/1989 Doan ..... 49/498.1
4,890,418 A 1/1990 Sachs
4,970,836 A 11/1990 Brown
5,283,979 A * 2/1994 Carlson et al. ..... 49/395
5,301,469 A * 4/1994 Lyons, Sr. ..... 49/386
5,327,682 A 7/1994 Holtz
5,473,842 A * 12/1995 Hillery ..... 49/504
5,653,061 A 8/1997 Hiner
5,784,839 A * 7/1998 LaVanway ..... 52/204.1
5,791,103 A * 8/1998 Coolman et al. ..... 52/215
6,041,553 A * 3/2000 Joyce et al. ..... 49/504
6,079,475 A 6/2000 Morgan et al.
6,141,922 A 11/2000 Carlisle et al.
6,151,848 A 11/2000 Hunter
6,167,656 B1 * 1/2001 Devlin et al. ..... 49/463
D448,489 S 9/2001 Jackson et al.
6,449,917 B1 * 9/2002 Sullivan, III ..... 52/506.06

(Continued)

*Primary Examiner*—Gay Ann Spahn
(74) *Attorney, Agent, or Firm*—Bowman Green Hampton & Kelly, PLLC

(57) ABSTRACT

A crawl space access door assembly having a frame that can be installed while a foundation of a home or other structure and a door is under construction or retrofitted to an existing structure. The crawl space access door frame assembly is sized so as to accept a removable crawl space access door. Sidewall ribs are formed so as to extend from the outer sides of the first sidewall and the second sidewall of the frame and operate in mating relationship with a groove formed in the blocks used to create the frame of the structure to aid in securing the crawl space access door frame assembly to the structure.

13 Claims, 10 Drawing Sheets

U.S. PATENT DOCUMENTS

| | | | | |
|---|---|---|---|---|
| 6,817,942 | B1 | 11/2004 | Betz | |
| 7,097,557 | B2 | 8/2006 | Kutschman | |
| 2004/0250486 | A1 | 12/2004 | Sibbett | |
| 2005/0113019 | A1 | 5/2005 | Kutschman | |
| 2005/0246982 | A1 * | 11/2005 | MacMillan et al. | 52/220.8 |

* cited by examiner

CRAWL SPACE ACCESS DOOR ASSEMBLY HAVING FRAME WITH REMOVABLE RIBS IN RIB RECEIVING GROOVES

CROSS-REFERENCE TO RELATED APPLICATIONS

This nonprovisional patent application claims the benefit of U.S. Provisional Patent Application Ser. No. 60/926,342, filed Apr. 26, 2007, the complete disclosure of which is incorporated herein by reference.

BACKGROUND OF THE INVENTION

1. Field of the Invention

This invention relates generally to crawl space access door assemblies. In particular, the present invention relates to a crawl space access door assembly that may be used to seal a crawl space access hole or opening.

2. Description of Related Art

Houses and other structures that sit above ground over what is commonly referred to as a "crawl space" require some means of exterior access to the under side of the house or other structure. Typically, this access has consisted of a wood or metal door encased in a metal frame. The entire assembly is usually installed during construction, and mortared into the structure's foundation.

SUMMARY OF THE INVENTION

However, known crawl space access doors are typically installed during construction, and are mortared into the structure's foundation, making it extremely difficult to remove or replace. Unfortunately for the building owner, there are several problems with the current design.

First, known assemblies are not airtight, and, therefore, they permit moisture, heat, and cold to penetrate the area. With the increasing popularity of totally sealed crawl spaces, current access doors simply do not provide adequate protection. Building owners may also be concerned that the current design will serve as a conduit for unwanted pests such as ants, spiders, or termites.

Another serious flaw with current designs is their tendency to corrode or decay within a short time after construction. This is an especially difficult problem in areas with high humidity and/or high salt content in the air. However, even the materials used to build a foundation contain corrosive ingredients such as lime or Portland cement, which will interact with the metal and cause it to degrade.

Thus, the present invention relates generally to an improved crawl space access door and crawl space access door assembly that is fabricated, at least in part, from a substantially non-corrosive material.

In various exemplary embodiments, the frame of the crawl space access door assembly comprises at least some of a first sidewall, a second sidewall, a top wall, a bottom wall. The elements of the crawl space access door assembly are attached, coupled, or assembled together so as to form a frame that can be installed while a foundation is under construction or retrofitted to an existing structure. The crawl space access door frame assembly is sized so as to accept a crawl space access door.

In various exemplary embodiments, the crawl space access door comprises at least some of a door that is fitted to be received within a crawl space access door frame assembly. In various exemplary embodiments, the door and crawl space access door frame assembly are constructed of similar materials. Alternatively, the door and crawl space access door frame assembly may be constructed of dissimilar materials. A gasket, such as, for example, a foam or rubber gasket, is installed either on the crawl space access door frame assembly or on the door, such that the gasket is compressed when the door is locked within the crawl space access door frame assembly.

In various exemplary, non-limiting embodiments, one or more latching mechanisms are used to removably secure the door within the crawl space access door frame assembly. In various exemplary embodiments, the latch mechanisms comprise corrosion-resistant cam latches.

When the door is locked within the crawl space access door frame assembly, an airtight seal is produced. When the materials used to form the various components of the crawl space access door are insulators, the entire crawl space access door assembly acts as a thermal barrier against exterior high and low temperatures. Additionally, the crawl space access door acts to prevent the penetration of air and moisture into the crawl space.

In various exemplary, non-limiting embodiments, the crawl space access door can be installed while a foundation is under construction. Alternatively, the crawl space access door can be retrofitted to an existing structure.

Since the crawl space access door is made of relatively inert materials, the crawl space access door is compatible with all types of building materials including cinder block, brick, concrete pour, brick veneer, building stone, and stucco. In addition, the crawl space access doors and crawl space access door frame assemblies are not affected by acid wash-downs or other processes using harsh chemicals that are frequently a part of building construction or maintenance.

Accordingly, this invention provides a crawl space access door of improved design.

This invention separately provides a crawl space access door, which is compatible with all types of building materials.

This invention separately provides a crawl space access door, which can be installed while a foundation of a structure is under construction.

This invention separately provides a crawl space access door, which can be retrofitted to existing structures.

These and other features and advantages of this invention are described in or are apparent from the following detailed description of the exemplary, non-limiting embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

For simplicity and clarification, the design factors and operating principles of the crawl space access door assembly according to this invention are explained with reference to various exemplary embodiments of a crawl space access door assembly according to this invention. The basic explanation of the design factors and operating principles of the crawl space access door assembly is applicable for the understanding, design, and operation of the crawl space access door assembly of this invention. It should be appreciated that the crawl space access door can be adapted to many applications where the presence of a removable or sealable "door" is needed.

It should also be appreciated that the terms "crawl space", "access door", "door", and "frame" are used for basic explanation and understanding of the operation of the systems, methods, and apparatuses of this invention. Therefore, the terms "crawl space", "access door", "door", and "frame" are not to be construed as limiting the systems, methods, and apparatuses of this invention. Furthermore, the terms "door" and "frame" are not to be construed as limiting the systems, methods, and apparatuses of this invention. Thus, the terms "door" and "frame" are to be understood to broadly include any structures or devices capable of being removably or pivotably secured together to cover an opening.

Figure 1:
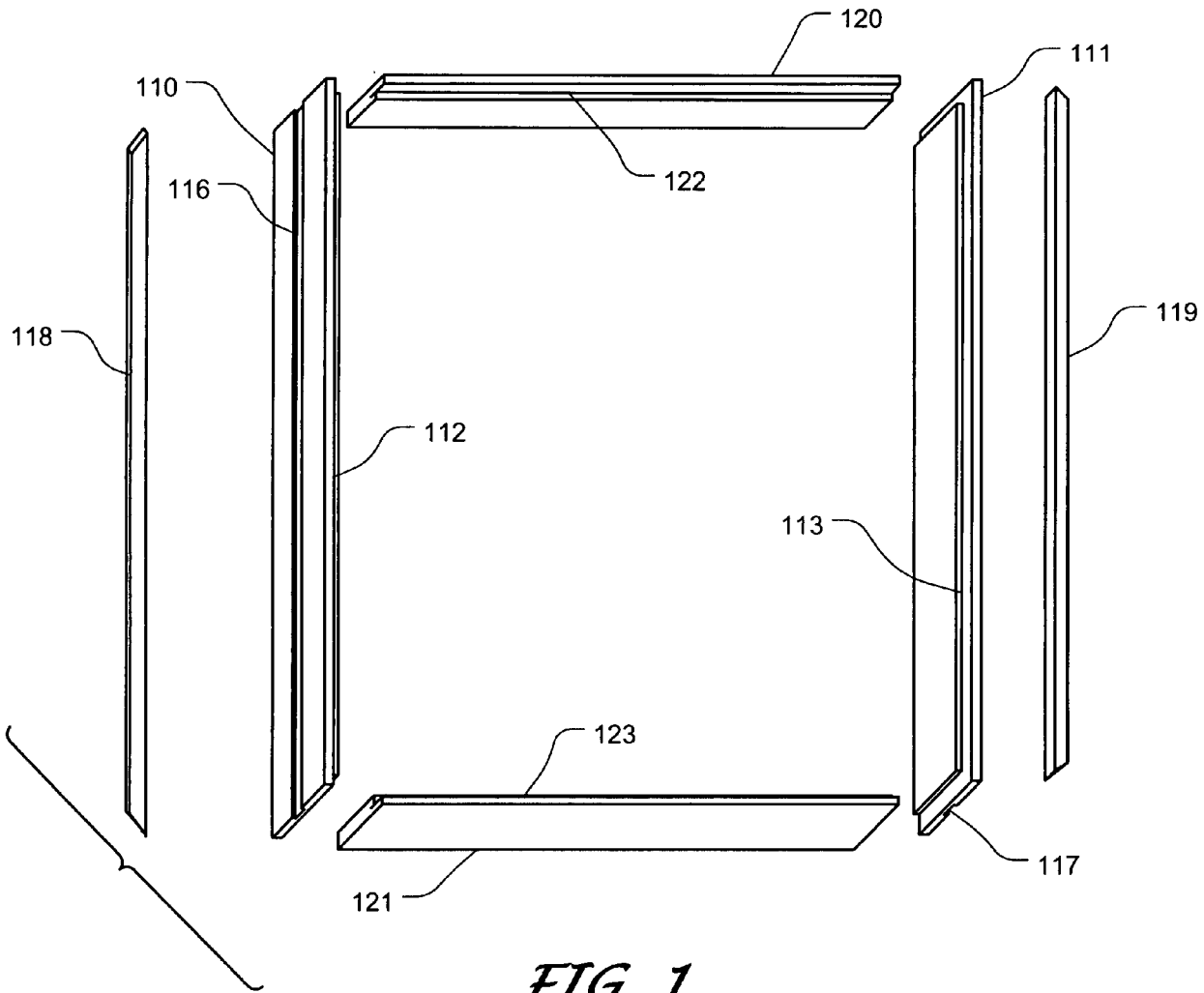
FIG. 1 shows an exploded perspective view of a first exemplary embodiment of a crawl space access door frame assembly according to this invention.
Figure 2:
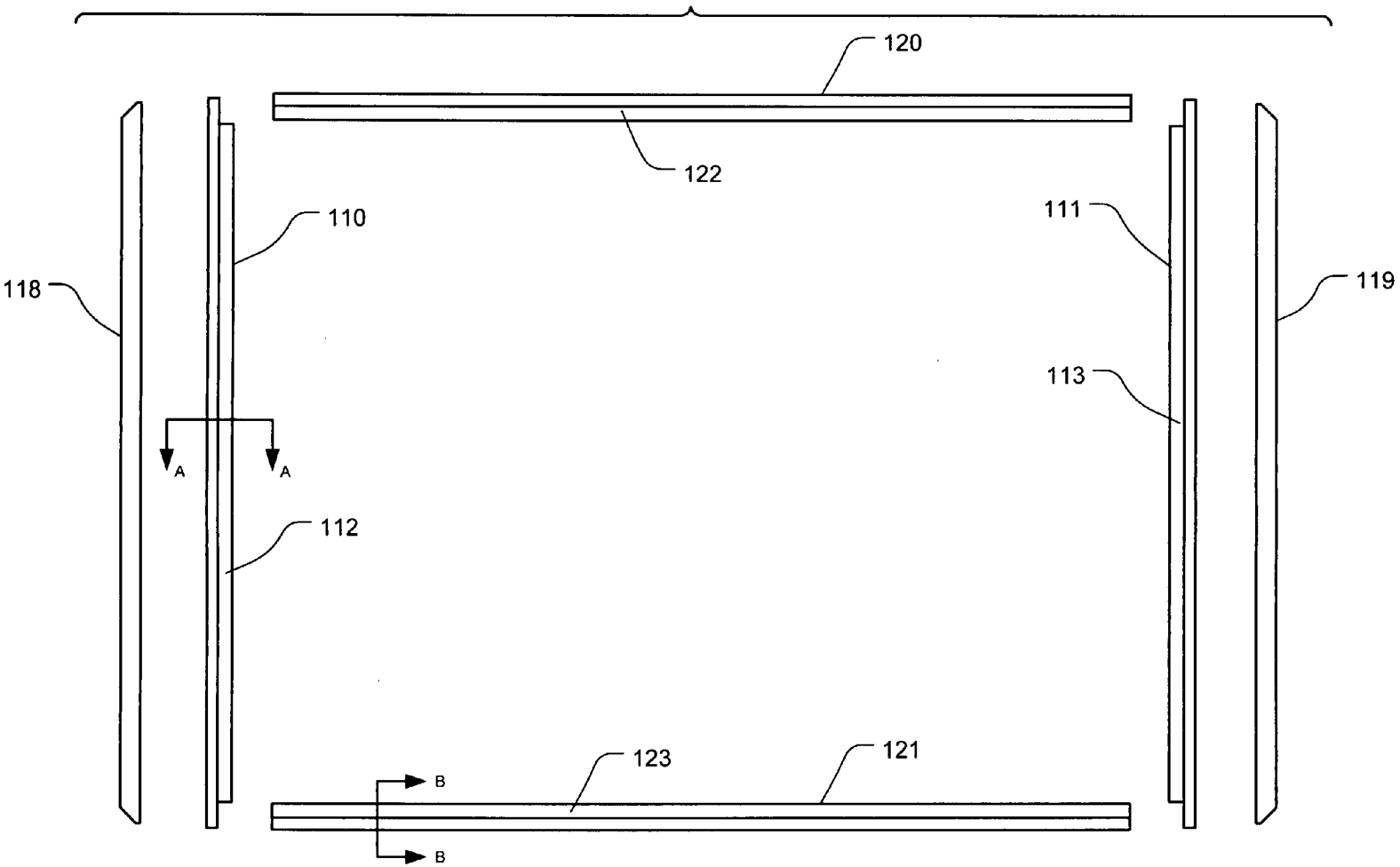
FIG. 2 shows an exploded plan view of a first exemplary embodiment of a crawl space access door frame assembly according to this invention.
Figure 3:
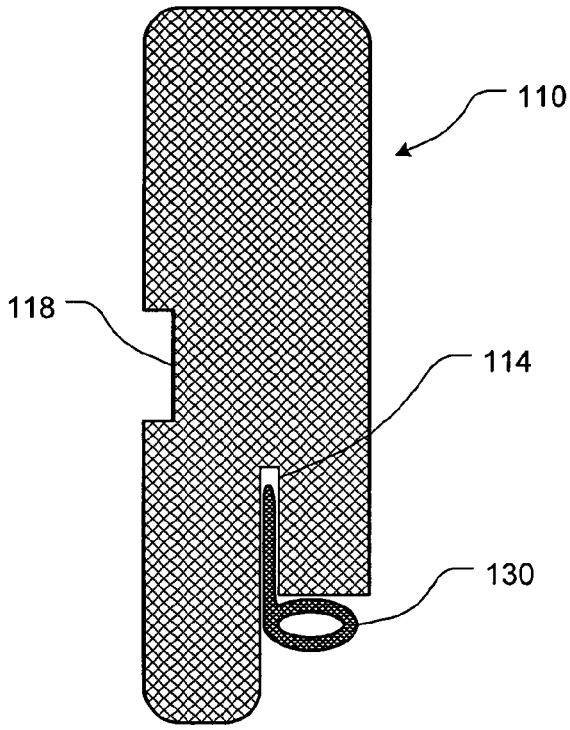
FIG. 3 shows a more detailed cross-sectional view taken along line 3-3 of the crawl space access door frame assembly of FIG. 2, illustrating an exemplary first side wall according to this invention.
Figure 4:
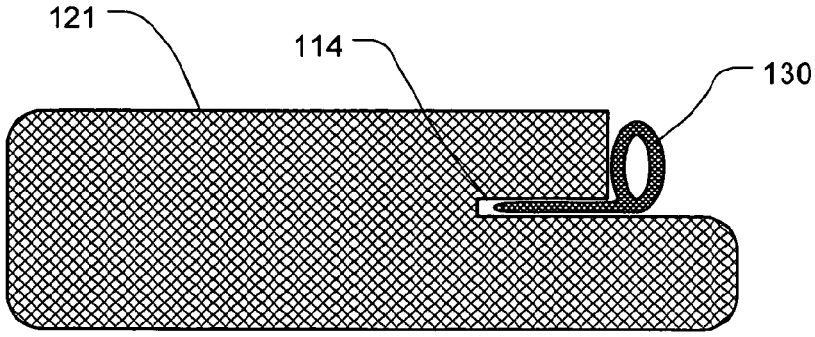
FIG. 4 shows a more detailed cross-sectional view taken along line 4-4 of the crawl space access door frame assembly of FIG. 2, illustrating an exemplary bottom wall according to this invention.
Figure 5:
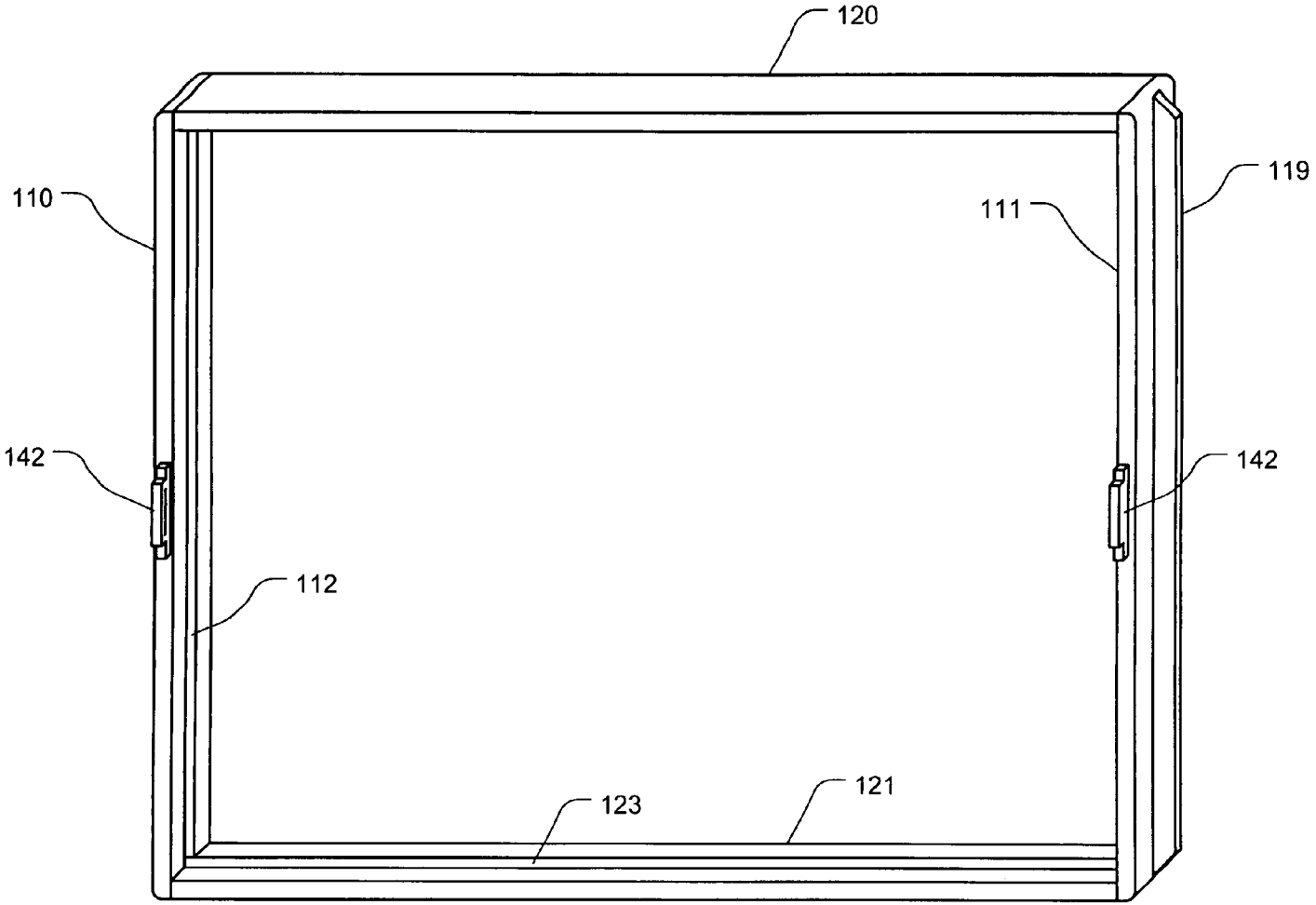
FIG. 5 shows a front perspective view of a partially assembled first exemplary embodiment of the crawl space access door assembly according to this invention.
Figure 6:
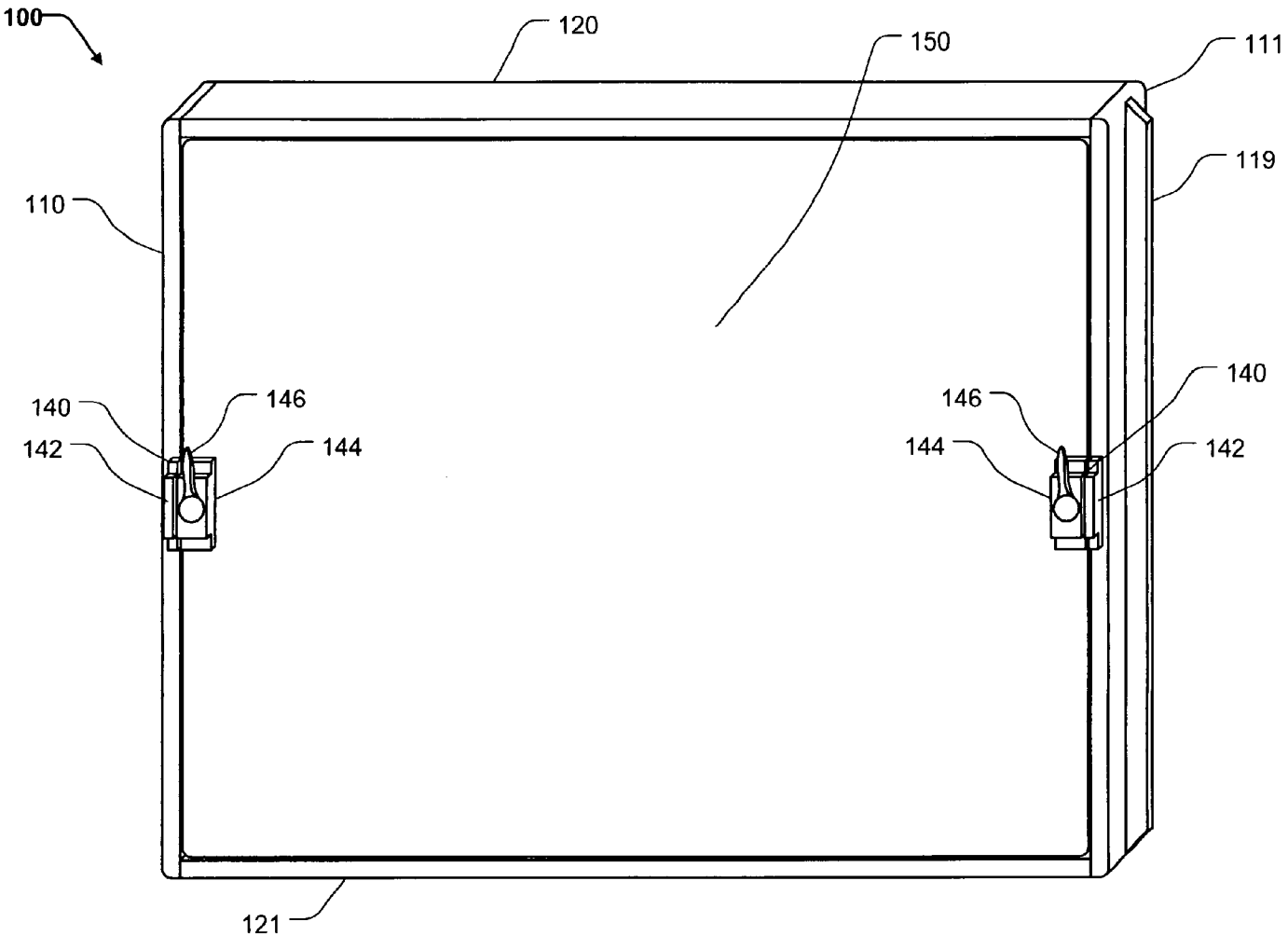
FIG. 6 shows a front perspective view of an assembled first exemplary embodiment of the crawl space access door assembly according to this invention.

Turning now to the drawing Figs., FIGS. 1 and 2 show an exploded perspective view and a front view, respectively, of certain of the components of a first exemplary embodiment of a crawl space access door frame assembly 100 according to this invention. FIGS. 3 and 4 show cross-sectional views of the first sidewall 110 and the bottom wall 121, taken along line 3-3 and line 4-4, respectively. FIG. 5 shows a perspective view of a partially assembled first exemplary embodiment of the crawl space access door assembly, and FIG. 6 shows a perspective view of an assembled first exemplary embodiment of the crawl space access door assembly 100 according to this invention.

In an illustrative, non-limiting embodiment of this invention, as illustrated in FIGS. 1-6, the crawl space access door frame assembly comprises at least some of a first sidewall 110, a second sidewall 111, a first sidewall rib 118, a second sidewall rib 119, a top wall 120, a bottom wall 121.

The first sidewall 110 and the second sidewall 111 are generally formed of an elongate portion of material having similar height, width, and depth dimensions and having an inner side, an outer side, a front side, and a rear side. Typically, the inner side of the first sidewall 110 and/or the second sidewall 111 is the side facing towards the interior of the crawl space access door frame assembly (defining an entrance aperture formed by the crawl space access door frame assembly), while the outer side of the first sidewall 110 and/or the second sidewall 111 is the side facing away from the crawl space access door frame assembly. Typically, the front side of the first sidewall 110 and/or the second sidewall 111 is the side that will be facing towards the exterior of the home or other structure in which the crawl space access door frame assembly is installed, while the rear side of the first sidewall 110 and/or the second sidewall 111 is the side facing into the crawl space of the home or other structure in which the crawl space access door frame assembly is installed.

Similarly, the top wall 120 and the bottom wall 121 are generally formed of an elongate portion of material having similar height, width, and depth dimensions and having an inner side, an outer side, a front side, and a rear side. Typically, the inner side of the top wall 120 and/or the bottom wall 121 is the side facing towards the interior of the crawl space access door frame assembly (defining an entrance aperture formed by the crawl space access door frame assembly), while the outer side of the top wall 120 and/or the bottom wall 121 is the side facing away from the crawl space access door frame assembly. Typically, the front side of the top wall 120 and/or the bottom wall 121 is the side that will be facing towards the exterior of the home or other structure in which the crawl space access door frame assembly is installed, while the rear side of the top wall 120 and/or the bottom wall 121 is the side facing into the crawl space of the home or other structure in which the crawl space access door frame assembly is installed.

It should be appreciated that the first sidewall 110 and the second sidewall 111 are substantially mirror images of one another. Likewise, the top wall 120 and the bottom wall 121 are substantially mirror images of one another. Thus, the first sidewall 110, second sidewall 111, top wall 120, and bottom wall 121 can be assembled together to form a square or rectangular frame.

In various exemplary, non-limiting embodiments, the crawl space access door is shaped so as to comply with certain building codes. For example, International Building Codes require crawl space access doors to be provided in certain standard sizes from a minimum of 16"×24" to 24"×32", 32"×32", and larger. It should be appreciated that the crawl space access door assembly of the present invention can be formed to accommodate any and all such standard sizes. However, it should also be appreciated that the crawl space access door and door assembly of the present invention is not limited to such standard sizes, and may be formed in any custom configuration.

In various exemplary embodiments, the elements of the crawl space access door frame, more specifically, the first sidewall 110, second sidewall 111, top wall 120, and bottom wall 121, are permanently or removably attached, coupled, or assembled together using screws, nails, adhesives, or other known or later developed means for attaching or coupling the crawl space access door frame components. It should also be appreciated that various elements of the crawl space access door frame may be formed as an integral unit or assembly.

Figure 7:
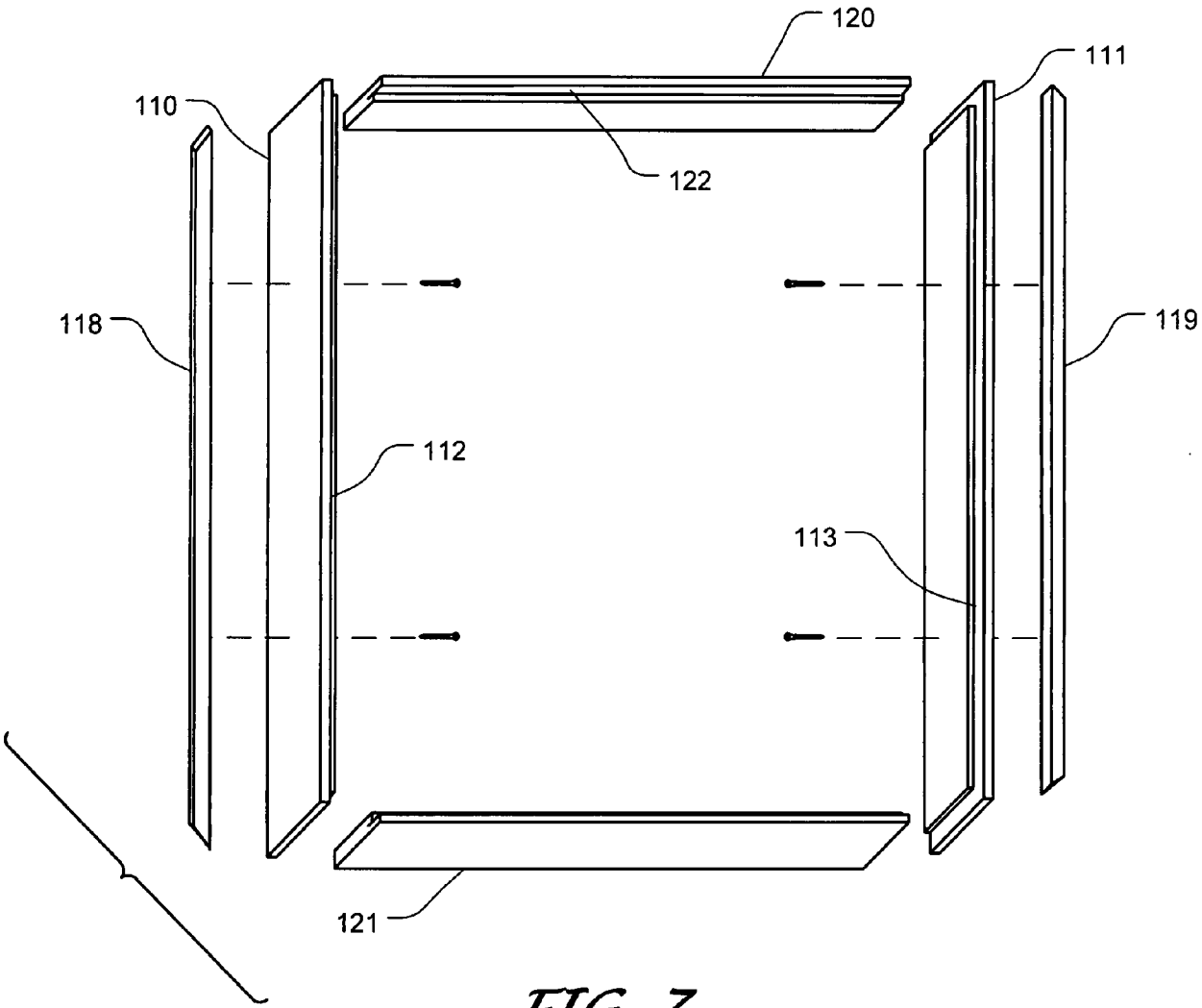
FIG. 7 shows an exploded perspective view of a second exemplary embodiment of a crawl space access door assembly according to this invention.

It should also be appreciated that, as illustrated in FIGS. 3-6, certain of the edges of the first sidewall 110, second sidewall 111, top wall 120, and bottom wall 121 can be radiused or rounded. Alternatively, as illustrated in FIGS. 1, 2, and 7, certain of the edges of the first sidewall 110, second sidewall 111, top wall 120, and bottom wall 121 can be substantially square. It should be understood that the finished profile of the various components of the crawl space access door assembly 100 is a design choice based upon the desired appearance and/or functionality of the a crawl space access door assembly 100.

Door receiving recess grooves 112, 113, 122, and 123 are formed in a portion of the front side of the first sidewall 110, second sidewall 111, top wall 120, and bottom wall 121, respectively. Each of the door receiving grooves is formed such that, when the frame walls are assembled, the door 150 may be at least partially received within a recess formed by the door receiving grooves. In various exemplary embodiments, when the door 150 is received within the door receiving grooves, an outer surface of the door 150 is flush or substantially flush with the front sides of the frame walls. Alternatively, when the door 150 is received within the door receiving grooves, an outer surface of the door 150 may be extended beyond or be recessed beneath the front sides of the frame walls.

In various exemplary, non-limiting embodiments, an optional rib receiving slot or groove 116 is formed in the outer side of the first sidewall 110. Likewise, an optional rib receiving slot or groove 117 is formed in the outer side of the second sidewall 111, along the longitudinal axis of the first sidewall 110 and the second sidewall 111. The optional rib receiving grooves 116 and 117, if included, are shaped so as to receive a portion of the first sidewall rib 118 and the second sidewall rib 119, respectively. The sidewall ribs 118 and 119 are formed so as to extend from the outer sides of the first sidewall 110 and the second sidewall 111 and operate in mating relationship with a groove formed in the blocks used to create the frame of the structure to aid in securing the crawl space access door frame assembly to a structure.

In various exemplary embodiments, the sidewall ribs 118 and 119 may be formed as an integral part of the first sidewall 110 and the second sidewall 111, or may be permanently or releasably attached or coupled to the first sidewall 110 and the second sidewall 111, within the rib receiving grooves 116 and 117.

In still other exemplary embodiments, as illustrated in FIG. 7, the rib receiving grooves 116 and 117 are not included and the sidewall ribs 118 and 119 are releasably or permanently coupled or attached to the outer side of the first sidewall 110 and the second sidewall 111 such that the crawl space access door frame assembly may be retrofitted to an existing home or structure to replace access doors of the existing structure. In these exemplary embodiments, the sidewall ribs 118 and 119 may first be placed within the grooves formed in the blocks used to create the frame of the existing structure. Then, the remaining components of the crawl space access door frame assembly are placed within the existing aperture for the crawl space door. Once appropriately positioned, screws, or other means, may be used to secure the first sidewall 110 and the second sidewall 111 to the sidewall ribs 118 and 119.

Figure 8:
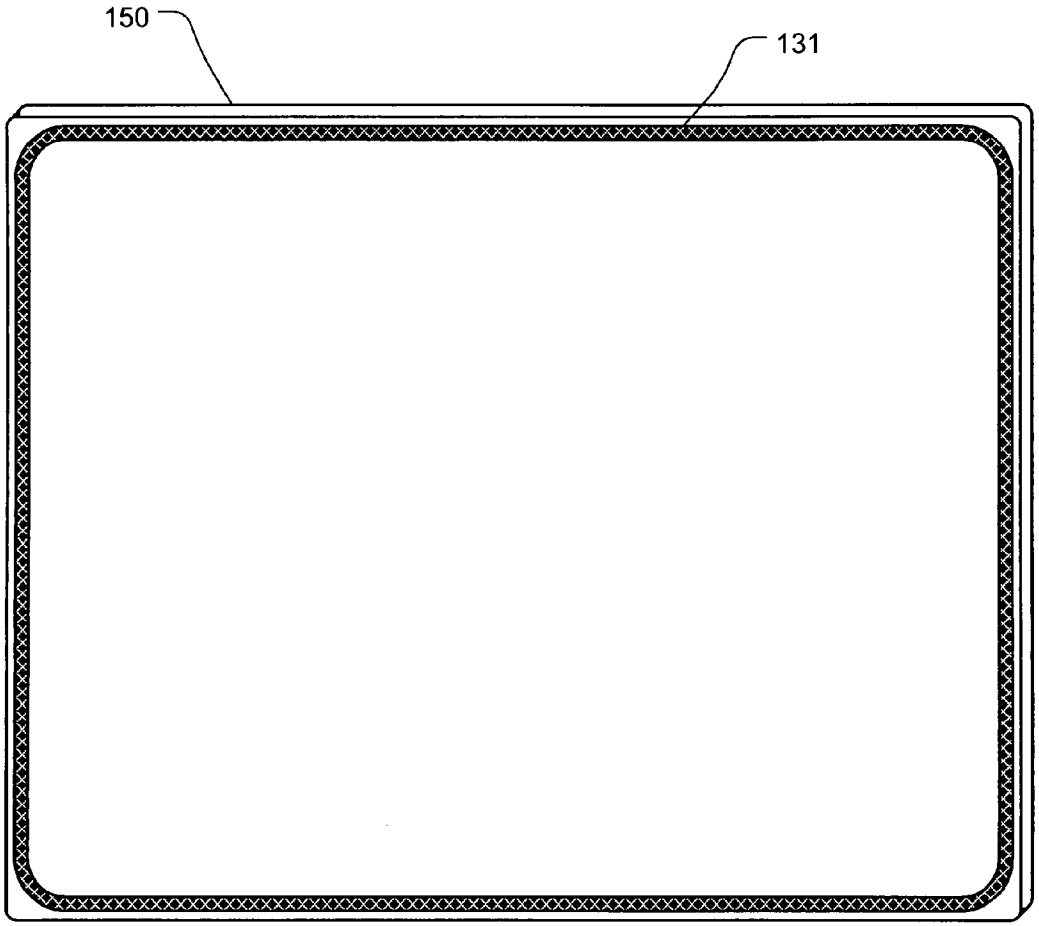
FIG. 8 shows a rear perspective view of a second exemplary embodiment of a crawl space access door according to this invention, wherein a gasket is included on the rear side of the crawl space access door.

In various exemplary embodiments, a seal or gasket 130 or 131, such as, for example, a foam or rubber gasket, is installed either within the door receiving recess grooves 112, 113, 122, and 123 or substantially around an inner perimeter of the rear side surface of the door 150, as illustrated in FIG. 8, such that the gasket 130 or 131 is at least partially contacted and/or compressed when the door 150 is locked within the crawl space access door frame assembly.

As illustrated most clearly in FIGS. 3 and 4, the gasket 130 may be formed such that a portion of the gasket 130 may be received within a gasket receiving groove 114 formed in the door receiving recess grooves 112, 113, 122, and 123. Alternatively, the gasket 131 may simply be attached or coupled within the door receiving recess grooves 112, 113, 122, and 123.

In various exemplary embodiments, one or more latching mechanisms 140 are used to removably secure the door 150 within the crawl space access door frame assembly. In various exemplary embodiments, the latch mechanisms comprise two-part, corrosion-resistant or powder-coated cam latches.

As illustrated in FIGS. 5 and 6, an exemplary latching mechanism 140 comprises a two-part latch mechanism, similar to a standard window latch. In these exemplary embodiments, a first portion 142 of the latch mechanism 140 is attached or coupled to the front side of the first sidewall 110. A mating, second portion 144 of the latch mechanism 140, including any latch toggle 146, is attached or coupled to the front side of the door 150. The first portion 142 and the second portion 144 are attached or coupled to the respective components of the crawl space access door assembly 100 so as to be a communicating relationship to allow the latch mechanism 140 to be locked or unlocked. When the latch toggle 146 is in a locked position, the first portion 142 is effectively latched, via a latch mechanism, to the second portion 144. When that latch toggle 146 is moved to the unlocked position, the first portion 142 is released from the latch mechanism of the second portion 144. Such latch mechanisms are well-known in the art. It should also be appreciated that a variety of known or later developed latch mechanisms or means may be used as the latch mechanism 140.

As illustrated herein, a first and second latch mechanisms 140 may be included, on opposite sides of the door 150, to facilitate closure of the crawl space access door assembly. However, it should be appreciated that the number, type, and position of latch mechanisms is a design choice based on the desired appearance and/or functionality of the crawl space access door assembly 100.

In various exemplary embodiments, once the crawl space access door frame assembly is installed, when the door 150 is locked or latched to the crawl space access door frame assembly, an airtight seal is produced. Furthermore, when the materials used to form the various components of the crawl space access door are insulators, the entire crawl space access door assembly acts as a thermal barrier against exterior high and low temperatures. Additionally, the crawl space access door acts to prevent the penetration of air and moisture into the crawl space.

In various exemplary, non-limiting embodiments, the crawl space access door frame assembly components of the crawl space access door assembly may be 3.5" wide and 1" thick, with a ⅝" step on the inside circumference to house the gasket, which provides the airtight or substantially airtight seal. In various exemplary, non-limiting embodiments, the door may be one half inch thick by the size of the opening with a powder coated cam-lock latch on each side of the door. The door and/or crawl space access door frame assembly components may be assembled from multiple components or fabricated as a single unit. With the possible exception of the locks, all components comprising the door and crawl space access door frame assembly may be made of a polymeric material, which is not only corrosion resistant, but also aesthetically pleasing.

In various exemplary embodiments, at least certain components of the crawl space access door and crawl space access door assembly are fabricated, at least in part, from a substantially rigid, polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, and/or various combinations of the foregoing. Thus, it should be understood that the material or materials used to form the components of the crawl space access door is a design choice based on the desired appearance and/or functionality of the crawl space access door.

While the systems, methods, and apparatuses of the current invention may provide for an airtight seal between the door and crawl space access door frame assembly, in various exemplary embodiments, the door element may comprise one or more screened or open apertures. The size, shape, and number of such screened or open apertures is a design choice based on the desired appearance and/or functionality of the crawl space access door. In this manner, multiple door configurations may be available to satisfy owner desires or insurance requirements.

Figure 9:
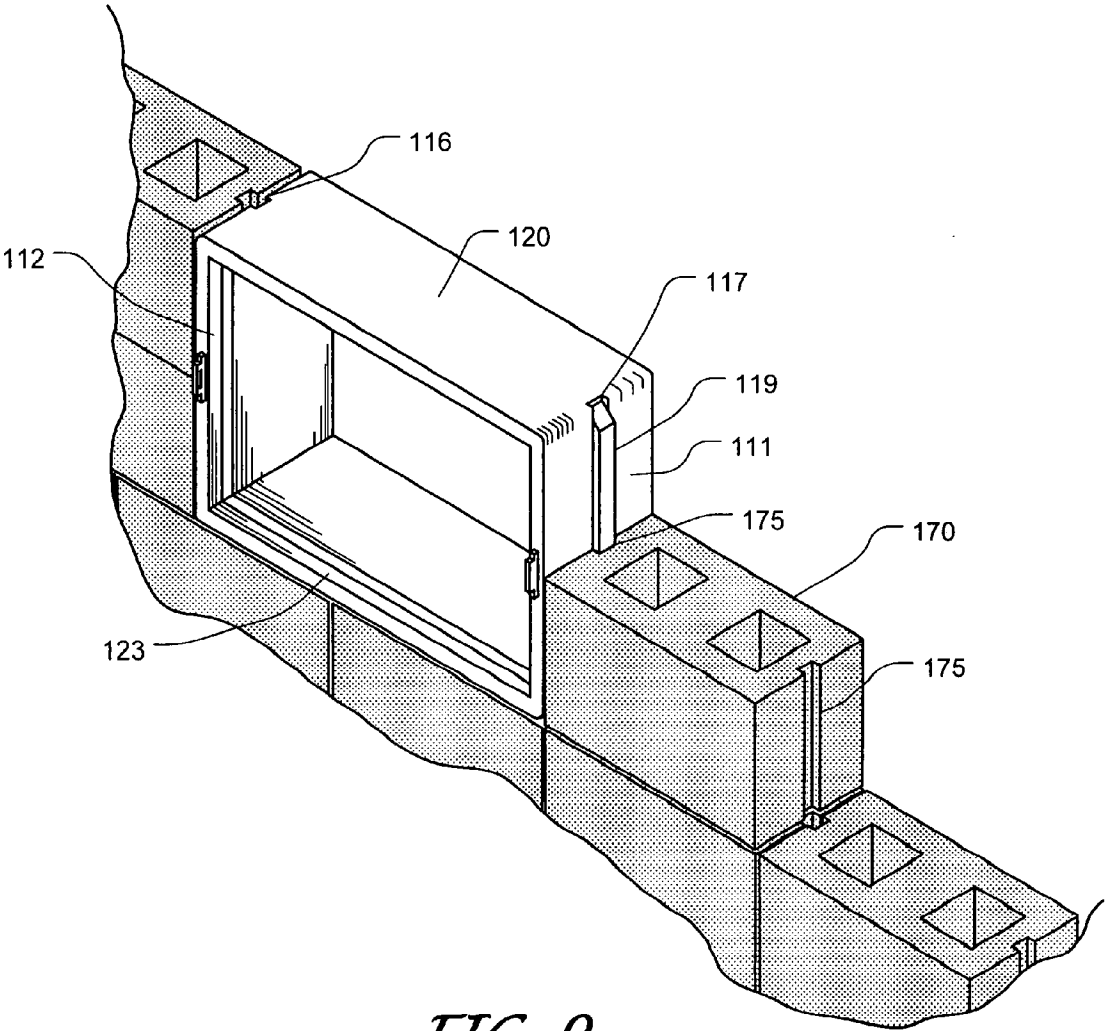
FIG. 9 shows a front perspective view of a first exemplary embodiment of a crawl space access door frame assembly installed in an opening of an exemplary crawl space according to this invention.

FIG. 9 shows a perspective view of a first exemplary embodiment of a crawl space access door frame assembly installed in an opening of an exemplary crawl space according to this invention. As illustrated, the sidewall ribs 118 and 119 extend from the outer sides of the first sidewall 110 and the second sidewall 111 and operate in mating relationship with a groove 175 formed in the blocks 170 used to create the frame of the structure and aid in securing the crawl space access door frame assembly to a structure.

Figure 10:
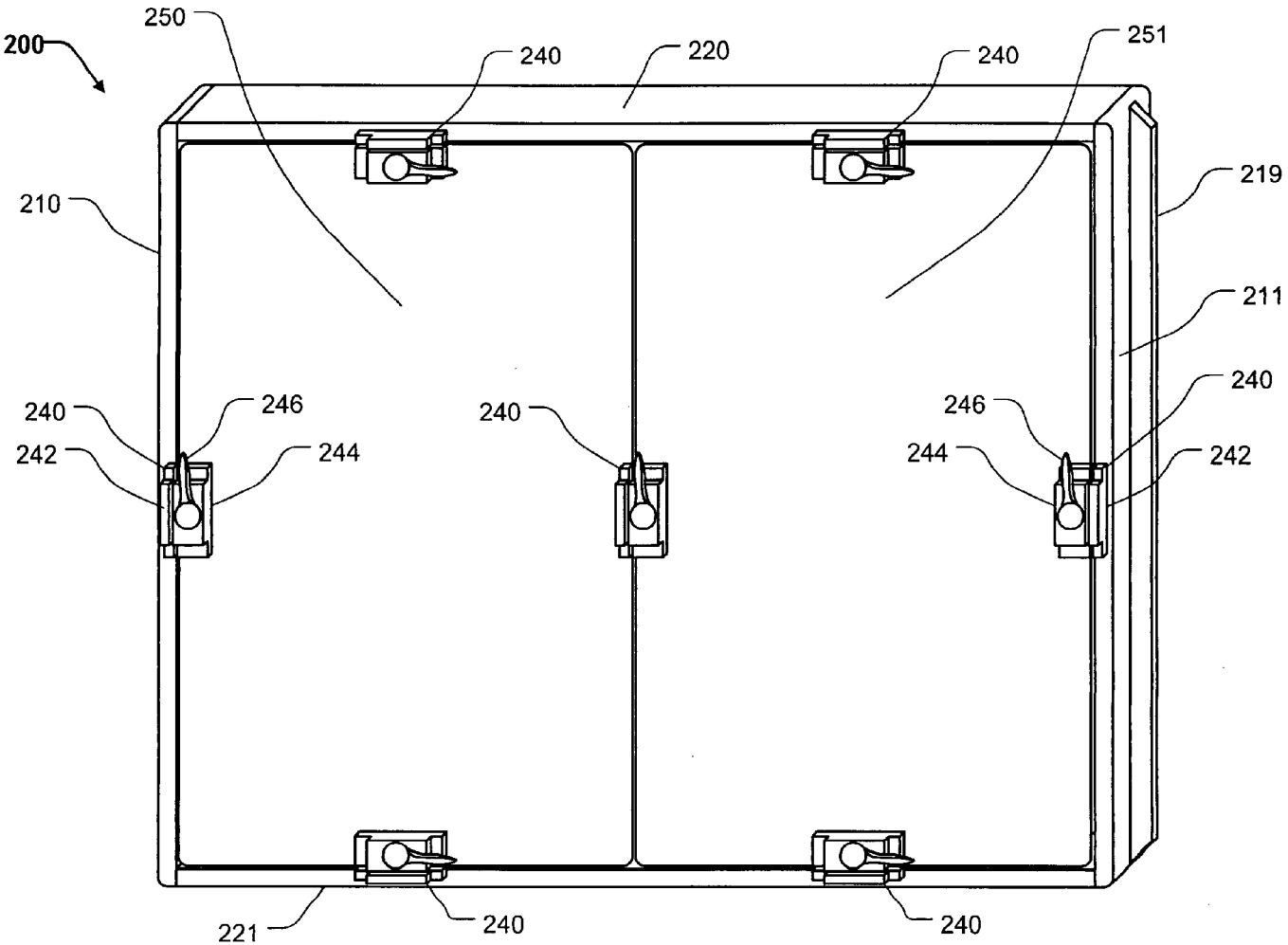
FIG. 10 shows a front perspective view of a second exemplary embodiment of a crawl space access door assembly according to this invention.

FIG. 10 shows a front perspective view of a second exemplary embodiment of a crawl space access door assembly 200 according to this invention. As shown in FIG. 9, the crawl space access door assembly 200 includes a first sidewall 210, a second sidewall 211, a first sidewall rib 218, a second sidewall rib 219, a top wall 220, a bottom wall 221, one or more latch mechanisms 240 each having a first portion 242, a second portion 244, and a latch toggle 246.

It should be understood that each of these elements corresponds to and operates similarly to the first sidewall 110, the second sidewall 111, the first sidewall rib 118, the second sidewall rib 119, the top wall 120, the bottom wall 121, the latch mechanism 140, the first portion 142, the second portion 144, and the latch toggle 146, as described above with reference to the crawl space access door assembly 100 of FIGS. 1-8.

However, as shown in FIG. 9, the crawl space access door assembly 200 comprises a first door 250 and a second door 251. While the first door 250 and a second door 251 operate similarly to the door 100 of the crawl space access door assembly 100, the open aperture defined by the crawl space access door frame assembly of FIG. 9 is covered by two doors.

In order to keep the first door 250 and a second door 251 in place, additional latches or latching mechanisms 240 are included at various locations to ensure that the first door 250 and a second door 251 can be appropriately coupled to the crawl space access door frame assembly.

It should be appreciated that in various exemplary embodiments, additional doors may be used to cover the open aperture defined by the crawl space access door frame assembly. Thus, the number of the doors and latches or latching mechanisms is a design choice based upon the desired appearance and/or functionality of the crawl space access door assembly.

Figure 11:
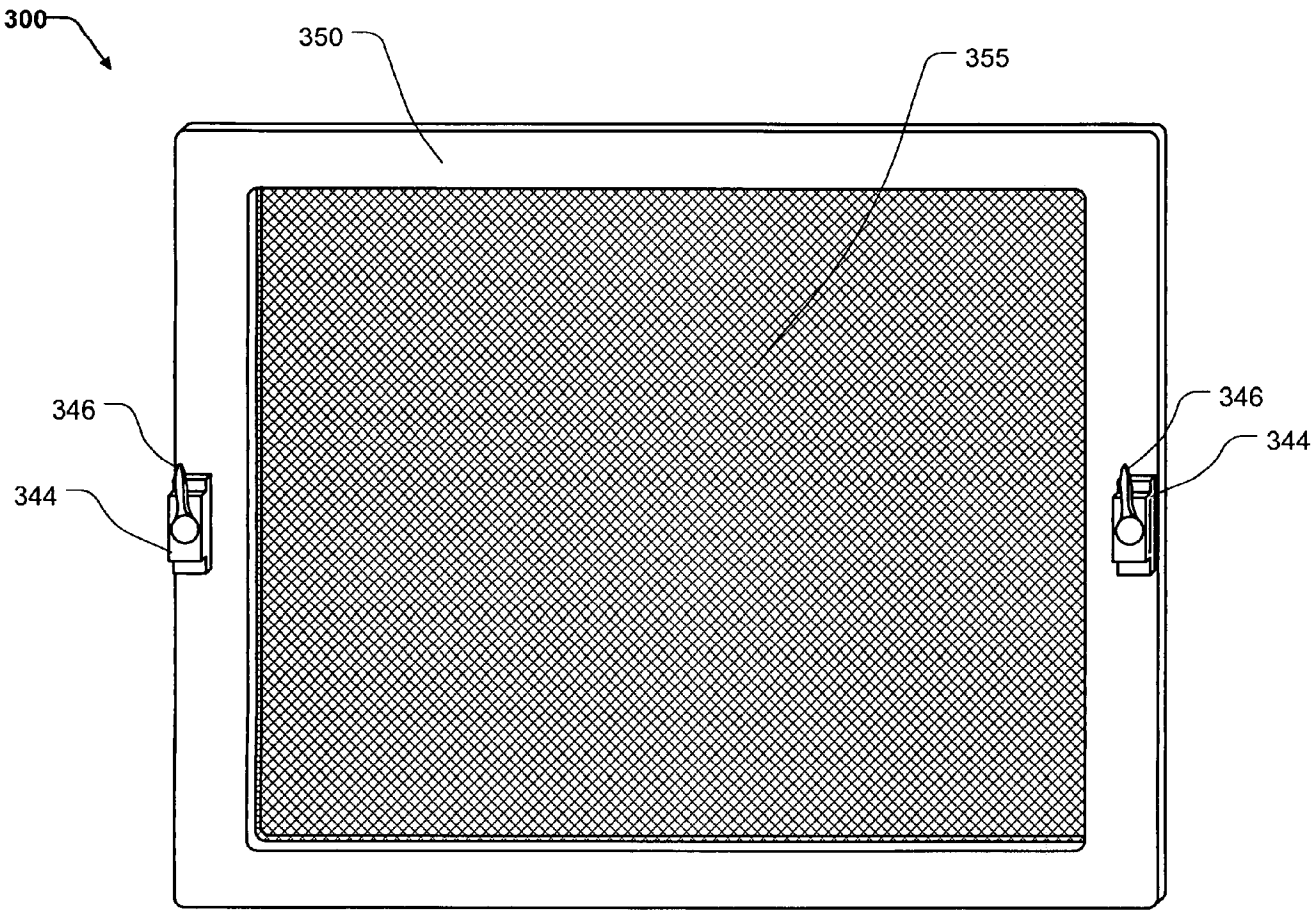
FIG. 11 shows a front perspective view of a second exemplary embodiment of a crawl space access door according to this invention.

FIG. 11 shows a perspective view of a second exemplary embodiment of a crawl space access door 350 according to this invention. As shown in FIG. 11, the crawl space access door 350 includes a second portion 344 and a latch toggle 346 of a latch mechanism 342.

It should be understood that each of these elements corresponds to and operates similarly to the second portion 144 or 244 and the latch toggle 146 or 246 of the latch mechanisms 140 or 240, as described above with reference to the crawl space access door assembly 100 or the crawl space access door assembly 200.

However, as illustrated in FIG. 11, the door 350 includes a screened portion 355. In applications where an airtight or substantially airtight seal is not necessary or desired, the solid door 150 (or doors 250 and 251) may be replaced by a door having a screened portion. It should be appreciated that the screened portion 355 may comprise multiple screened portions, one or more apertures, or one or more louvered portions.

While this invention has been described in conjunction with the exemplary embodiment(s) outlined above, it is evident that this invention is not limited to particular variation(s) set forth and many alternatives, adaptations, modifications, and variations will be apparent to those skilled in the art. For example, the design factors and operating principles of the crawl space access door may be applied to crawl space vents. As with the crawl space access door, a crawl space access door frame assembly may be constructed from a polymeric or other material with an airtight or substantially airtight seal, with the option of a screened or solid door.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Such alternatives, adaptations, modifications, and variations should and are intended to be and are comprehended within the meaning and range of equivalents of the disclosed exemplary embodiment(s) and may be substituted without departing from the true spirit and scope of the invention. It is to be understood that the phraseology of terminology employed herein is for the purpose of description and not of limitation. Accordingly, the foregoing description of the exemplary embodiments of the invention, as set forth above, are intended to be illustrative, not limiting and the fundamental design should not be considered to be necessarily so constrained. Various changes, modifications, and/or adaptations may be made without departing from the spirit and scope of this invention.

What is claimed is:

1. A crawl space access door assembly, comprising:

a door, wherein the door is formed of substantially planar portion of material having at least a front side and a rear side;

a first sidewall, wherein the first sidewall is formed of an elongate portion of material having at least an inner side, an outer side, a front side, and a rear side;

a second sidewall, wherein the second sidewall is formed of an elongate portion of material having at least an inner side, an outer side, a front side, and a rear side, and wherein the second sidewall is substantially a mirror image of the first sidewall;

a top wall, wherein the top wall is formed of an elongate portion of material having at least an inner side, an outer side, a front side, and a rear side;

a bottom wall, wherein the bottom wall is formed of an elongate portion of material having at least an inner side, an outer side, a front side, and a rear side, and wherein the bottom wall is substantially a mirror image of the top wall;

wherein the first sidewall, the second sidewall, the top wall, and the bottom wall are assembled to define a crawl space access door frame assembly and an entrance aperture of the crawl space access door assembly;

wherein door receiving grooves are formed in a portion of the front sides of the first sidewall, the second sidewall, the top wall, and the bottom wall, wherein the door receiving grooves extend from the front sides of the first sidewall, the second sidewall, the top wall, and the bottom wall, and wherein each of the door receiving grooves is formed such that, when the crawl space access door frame assembly is assembled, the door is capable of being at least partially received within the door receiving grooves such that the front side of the door is flush with the front sides of the first sidewall, the second sidewall, the top wall, and the bottom wall;

a first rib receiving groove, wherein the first rib receiving groove is formed in the outer side of the first sidewall along a longitudinal axis of the first sidewall;

a first sidewall rib removably attached within and extending from the first rib receiving groove;

a second rib receiving groove, wherein the second rib receiving groove is formed in the outer side of the second sidewall along a longitudinal axis of the second sidewall;

a second sidewall rib removably attached within and extending from the second rib receiving groove; and one or more latching mechanisms capable of removably securing the door to the crawl space access door frame assembly.

2. The crawl space access door assembly of claim 1, wherein:

the inner side of the first sidewall, the second sidewall, the top wall, and the bottom wall is the side facing towards an interior of the crawl space access door frame assembly;

the outer side of the first sidewall, the second sidewall, the top wall, and the bottom wall is the side facing away from the crawl space access door frame assembly;

the front side of the first sidewall, the second sidewall, the top wall, and the bottom wall is the side that is to face towards the exterior of the structure when the crawl space access door frame assembly is installed; and the rear side of the first sidewall, the second sidewall, the top wall, and the bottom wall is the side that is to face into the interior of the structure when the crawl space access door frame assembly is installed.

3. The crawl space access door assembly of claim 1, wherein the first sidewall, the second sidewall, the top wall, and the bottom wall, are assembled together to form a substantially rectangular crawl space access door frame assembly.

4. The crawl space access door assembly of claim 1, wherein an outer dimension of the crawl space access door assembly is between at least 16"×24" and at least 32"×32".

5. The crawl space access door assembly of claim 1, wherein the first sidewall, the second sidewall, the top wall, and the bottom wall, are permanently assembled together.

6. The crawl space access door assembly of claim 1, wherein the door receiving grooves are formed such that, when the first sidewall, the second sidewall, the top wall, and the bottom wall are assembled, the door is capable of being fully received within the recess formed by the door receiving grooves such that the front side of the door is flush with the front sides of the first sidewall, the second sidewall, the top wall, and the bottom wall.

7. The crawl space access door assembly of claim 1, further comprising at least one gasket positioned between the door receiving grooves and the door, such that the gasket is at least partially contacted and/or compressed when the door is secured to the crawl space access door frame assembly.

8. The crawl space access door assembly of claim 7, wherein the gasket is attached within the door receiving grooves, via gasket receiving grooves formed adjacent the door receiving grooves.

9. The crawl space access door assembly of claim 7, wherein the gasket is attached substantially around an inner perimeter of a rear side surface of the door.

10. The crawl space access door assembly of claim 1, wherein each latch mechanism comprises a two-part cam latch, wherein a first portion of the latch mechanism is attached to the front side of the first sidewall and a mating, second portion of the latch mechanism is attached to the front side of the door.

11. The crawl space access door assembly of claim 1, wherein the door is formed of a solid portion of material.

12. The crawl space access door assembly of claim 1, wherein the one or more latching mechanisms are accessible from the front side of the door.

13. The crawl space access door assembly of claim 1, wherein the door receiving grooves of each of the first sidewall, the second sidewall, the top wall, and the bottom wall comprise a first wall extending rearwardly from the front sides of the first sidewall, the second sidewall, the top wall, and the bottom wall, respectively, and a second wall extending inwardly from said first wall.

* * * * *